United States Patent [19]

Spicer

[11] 4,317,002

[45] Feb. 23, 1982

[54] MULTI-CORE POWER CABLE

[75] Inventor: Lyndon R. Spicer, Llandevaud, Wales

[73] Assignee: International Standard Electric Corporation, New York, N.Y.

[21] Appl. No.: 87,893

[22] Filed: Oct. 24, 1979

[30] Foreign Application Priority Data

Nov. 21, 1978 [GB] United Kingdom ..... 45336/78

[51] Int. Cl.[3] ..... H01B 7/22

[52] U.S. Cl. ..... 174/105 R; 174/28; 174/113 R

[58] Field of Search ..... 174/105 R, 113 R, 28

[56] References Cited

U.S. PATENT DOCUMENTS

| | | | |
|---|---|---|---|
| 466,268 | 12/1891 | Marsh | 174/105 R X |
| 3,193,712 | 7/1965 | Harris | 174/105 R X |
| 3,484,679 | 12/1969 | Hodgson | 174/105 R X |
| 3,485,224 | 12/1969 | Ronald | 174/105 R X |
| 3,602,632 | 8/1971 | Ollis | 174/113 R X |
| 3,697,671 | 10/1972 | Parker | 174/113 R X |
| 3,968,463 | 7/1976 | Boysen | 174/28 X |
| 4,028,660 | 6/1977 | Pitts | 174/115 X |

FOREIGN PATENT DOCUMENTS

| | | | |
|---|---|---|---|
| 272407 | 6/1927 | United Kingdom | 174/105 R |

*Primary Examiner*—Richard R. Kucia

*Attorney, Agent, or Firm*—John T. O'Halloran; Thomas N. Twomey

[57] ABSTRACT

A multi-core power cable (1) in which the conductors comprise a central conductor (2) and two or more tubular conductors (4, 6) coaxial with the central conductor (2), at least the tubular conductors forming the cores. The conductors (2, 4, 6) are isolated from one another by insulating layers (3, 5, 7). A sheath (8) and armoring (9, 10) may also be provided.

7 Claims, 2 Drawing Figures

MULTI-CORE POWER CABLE

This invention relates to multi-core power cables and, in particular, to three core power cables suitable for use as an oil well down-hole pump cable.

Down-hole electrically-energised pumps are used in oil wells to pump the oil therefrom. The ambient temperatures to which the pumps and power cables connected thereto are subjected is dependent on the depth and can be as high as 280° F. The power cables employed must be able to withstand such high temperatures as well as being flexible and capable of being extracted from the hole and coiled at very much lower temperatures, for example −30° F. in arctic regions. The cables must have very high breaking loads, be abrasion resistant, be able to withstand high pressures and be unaffected by the corrosive environment in which they are located, which may comprise brine, crude oil or a mixture of both, together with various corrosive materials such as hydrogen sulphide, hydrochloric acid etc.

Previously down-hole pump cables have included three individually insulated copper or aluminum conductors, stranded together and arranged in a common jacket with the various interstices filled, and armouring in the form of interlocked steel tape provided on the jacket. The conductors themselves may be solid or of a stranded construction. The existing cables are not very satisfactory and a considerable number of breakdowns occur, caused mainly by corrosion, wear and handling damage.

It is an object of the present invention to provide alternative constructions of multi-core power cable, and in particular to provide three core power cables suitable for use as oil-well down-hole pump cables, although in its broadest form the invention could well have a different application.

According to one aspect of the present invention there is provided a multi-core power cable including a central conductor and two or more coaxial tubular conductors arranged around the central conductor, each conductor being insulated from the adjacent conductor or conductors by electrically insulating material, said conductors forming the cores.

According to another aspect of the present invention there is provided a method of manufacturing a multi-core power cable comprising providing a central conductor, arranging a first insulating layer about the central conductor, arranging a first tubular conductor on the first insulating layer, arranging a second insulating layer on the first tubular conductor, and arranging a second tubular conductor on the second insulating layer, at least the tubular conductors forming the cores.

Figure 1:
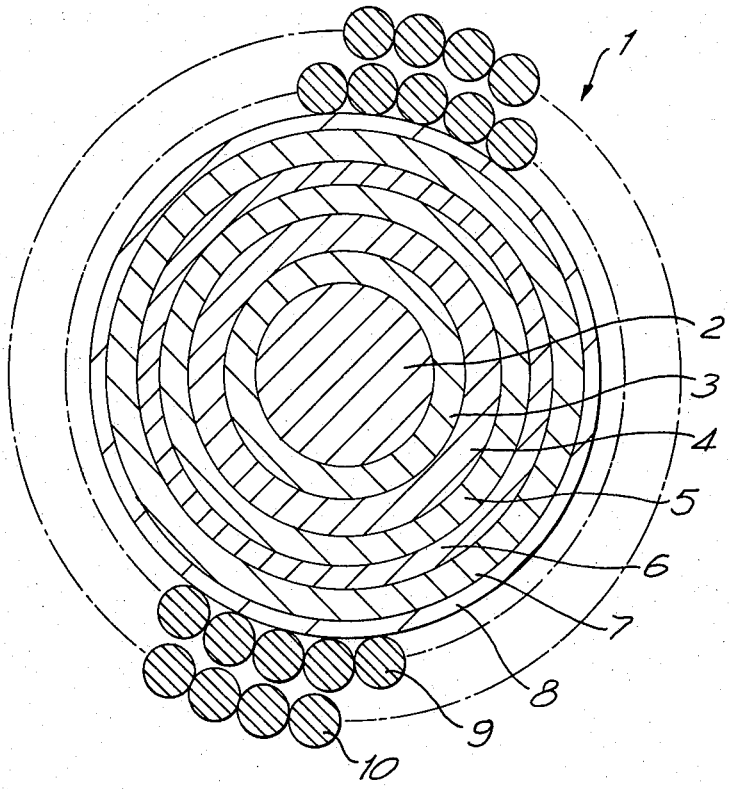
Figure 2:
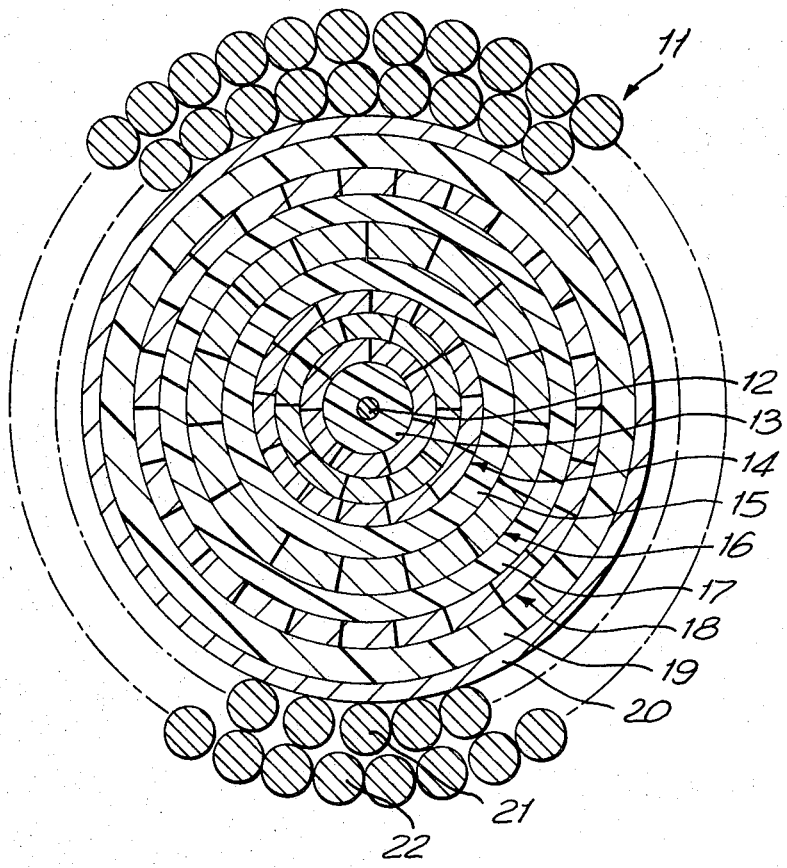

Embodiments of the invention will now be described with reference to the accompanying drawings in which:

FIG. 1 shows somewhat schematically a section through a down-hole pump power cable according to one embodiment of the present invention, and FIG. 2 shows somewhat schematically a section through a down-hole pump power cable according to another embodiment of the present invention.

In FIG. 1 power cable 1 comprises a central conductor 2, which is surrounded by an insulating layer 3, a tubular first outer conductor 4, an insulating layer 5, a tubular second outer conductor 6, an insulating layer 7, a sheath 8 and two layers of armouring wires 9 and 10.

The metallic cross-sections of the three conductors 2, 4 and 6 are equal.

In a specific example of cable having an overall diameter of 1.186" and in accordance with FIG. 1, the conductor 2 comprises nineteen 0.0591" diameter plain annealed copper wires stranded together and with the interstices between the wires filled with silicone rubber injected therein during stranding in a conventional manner. The insulating layers 3, 5 and 7 may comprise solid TPX (Trade name of Polymethyl Pentene) extruded onto the adjacent inner one of the conductors 2, 4 and 6 in a conventional manner to a radial thickness of 0.050". The conductor 4 comprises nineteen 0.0591" diameter plain annealed copper wires stranded over the insulating layer 3 in a single layer with the interstices filled with silicone rubber. The conductor 6 comprises fifty two 0.0358" diameter plain annealed copper wire stranded over the insulating layer 5 in a single layer with the interstices filled with silicone rubber. The silicone rubber filling is performed such that the interstices between the conductor wires and between the wires and the adjacent insulating layer or layers will be filled. Over the insulating layer 7 is extruded a sheath of, for example, Nylon 11 to a radial thickness of 0.030". The armouring comprises two layers of 0.085" galvanized plough steel wires which may be applied by conventional armouring techniques. The first layer comprises twenty nine wires 9, and the second layer comprises thirty seven wires 10. The breaking load of this cable is of the order of 80,000 lbs, and will operate in environmental oil temperatures greater than 280° F. It is suitable for use in the corrosive environment of oil wells and the silicone rubber filling ensures that the cable is gas-blocked and suitable for high pressure operation. The use of two layers of armouring wires overcomes the wear and handling damage problems encountered with the previously employed interlocked steel tape armouring, whilst the TPX and Nylon 11 are suitable for use at the high temperatures involved and are corrosion resistant although alternative materials with suitable properties could be employed.

It is possible to include one or more instrumentation (sensor or control) wires in the cable construction of FIG. 1, by for example arranging insulated or uninsulated wires in any or all of the insulating layers 3, 5 and 7.

In FIG. 2 the power cable 11 comprises a control conductor 12, which is surrounded by an insulating layer 13, a central tubular first power conductor 14, an insulating layer 15, a tubular second power conductor 16, an insulating layer 17, a tubular third power conductor 18, an insulating layer 19, a sheath 20 and two layers of armouring wires 21 and 22. The metallic cross-sections of the three conductors 14, 16 and 18 are equal.

In a specific example of cable having an overall diameter of 1.30" and in accordance with FIG. 2, the control conductor 12 comprises an 0.036" diameter plain annealed copper wire. Insulating layer 13 comprises solid TPX extruded onto core 12 to a radial thickness of 0.057". The first power conductor 14 comprises three layers of 0.080"×0.040" rectangularly sectioned plain annealed copper wire applied helically, there being seven wires in the innermost layer, ten in the middle and thirteen in the outermost layer. The interstices between the conductor wires and the adjacent layers are filled with silicone rubber injected therein, during laying up, in a conventional manner. Over the first power conductor 14 is extruded an insulating layer 15 of solid TPX having a radial thickness of 0.055". The second power conductor 16 comprises a single layer of fifteen plain annealed copper wires with an 0.110"×0.056" rectangular section applied helically, the interstices between the conductors being filled with silicone rubber. Over the second power conductor 16 is extruded an insulating layer 17 of solid TPX having a radial thickness of 0.050". The third power conductor 18 comprises a single layer of twenty six plain annealed copper wires with an 0.084"×0.042" rectangular section applied helically, the interstices between the conductors being filled with silicone rubber. Over the third power conductor 18 is extruded an insulating layer 19 of solid TPX having a radial thickness of 0.050". Over the insulating layer 19 is extruded a sheath 20 of Nylon 11 to a radial thickness of 0.032". The armouring comprises two layers of 0.085" galvanised plough steel wires. The first layer comprises thirty three wires 21, and the second layer forty one wires 22. These armouring wires may be applied by conventional armouring techniques or use may be made of wires which have been performed to a helically configuration which can be snapped on to the preceding sheath or armour layer. The wires 21 of the first layer in this example would need to be preformed with an angle to the longitudinal of 26°, whereas those wires 22 of the second layer would need to be preformed with an angle to the longitudinal of 17°. The breaking load of this cable is of the order of 85,000lbs.

Whilst the invention has been described with respect to a three core (three coaxial conductors) construction, other multi-core power cables not necessarily for oil wells could be designed using the same coaxial principle, for example a four core cable employing a central conductor and three coaxial tubular conductors arranged thereon, each conductor being insulated from the adjacent conductor or conductors. In addition the two layer armouring may be omitted altogether or replaced by an alternative, such as interlocked steel tape, for certain applications.

I claim:

1. A multi-core power cable comprising:

a central conductor, a first insulating layer disposed coaxially around said central conductor, at least one tubular intermediate conductor disposed coaxially around said first insulating layer, an intermediate insulating layer disposed coaxially around each said intermediate conductor, an outer tubular conductor disposed coaxially around said intermediate insulating layer, at least one of said conductors comprising a plurality of stranded wires and interstitial spaces, said interstitial spaces being filled with a flexible material, said conductors forming cores and being of substantially equal cross-section, an insulating layer disposed over said outer tubular conductor, a sheath arranged over said insulating layer, and armouring arranged over said sheath.

2. A cable as claimed in claim 1, wherein the armouring comprises two layers of armouring wires.

3. A cable as claimed in claim 1 wherein the insulating material comprises extruded polymethyl pentene.

4. A cable according to claim 1, wherein the sheath comprises extruded Nylon 11.

5. A cable as claimed in claim 2, wherein the armouring wires comprise galvanized plough steel wires.

6. A cable as claimed in claim 1, wherein the conductors are made of copper.

7. A cable as claimed in claim 1, wherein said flexible material is silicone rubber.

* * * * *